US006550883B2

(12) United States Patent
Oriol

(10) Patent No.: US 6,550,883 B2
(45) Date of Patent: Apr. 22, 2003

(54) METHOD AND APPARATUS FOR CONTROLLING INK DRYING TIME IN A HARDCOPY APPARATUS

(75) Inventor: Aleix Oriol, Barcelona (ES)

(73) Assignee: Hewlett-Packard Company, Fort Collins, CO (US)

( * ) Notice: Subject to any disclaimer, the term of this patent is extended or adjusted under 35 U.S.C. 154(b) by 0 days.

(21) Appl. No.: 09/935,715

(22) Filed: Aug. 24, 2001

(65) Prior Publication Data

US 2003/0038851 A1 Feb. 27, 2003

(51) Int. Cl.[7] ..... B41J 29/38
(52) U.S. Cl. ..... 347/14; 347/19
(58) Field of Search ..... 347/14, 16, 18, 347/41, 62, 102, 19

(56) References Cited

U.S. PATENT DOCUMENTS

| | | | | |
|---|---|---|---|---|
| 4,469,026 A | 9/1984 | Irwin | ..... | 101/426 |
| 5,608,439 A | 3/1997 | Arbeiter et al. | ..... | 347/102 |
| 5,714,990 A | 2/1998 | Courtney | ..... | 347/14 |

*Primary Examiner*—Lamson Nguyen

(57) ABSTRACT

To substantially avoid the effects of bleeding of ink printed in successive printing passes in a hardcopy apparatus, the drying time between the passes is varied to take into account the amount of ink deposited in a preceding pass and/or to be deposited in the next pass. The type of ink being used, the prevailing temperature, the prevailing humidity and/or the type of print media being used may also be taken into account. At the end of a plot, the drying time is also varied so that the total drying time can remain constant.

13 Claims, 1 Drawing Sheet

METHOD AND APPARATUS FOR CONTROLLING INK DRYING TIME IN A HARDCOPY APPARATUS

FIELD OF THE INVENTION

The present invention relates to controlling the drying time of ink in a hardcopy apparatus. In particular, the present invention relates to varying the time between successive passes of a printhead in a printer in dependence upon one or more printing variables.

BACKGROUND OF THE INVENTION

In printers, the interswath drying time is the time the printer carriage remains (after one pass is printed) at one side of the printer before the printing of the next pass begins. This time may range between about zero and two seconds. The reason for the existence of this interswath drying time is the need for a certain amount of time for the ink to wet the print medium properly and prevent substantial mixing with or bleeding into subsequently applied ink. In the absence of an appropriate interswath drying time, solid color blocks printed next to each other may bleed and result in blurred edges. In addition, secondary color blocks may show mottled or non-uniform area fills.

Interswath drying time is conventionally complemented with an "end of plot" drying time, which is the time between the plot or printing task being finished and a subsequent cutting of the print media by a print media handling unit, if necessary, and deposition of a cut print media in a bin or other receptacle. The reason for this "end of plot" drying time is to substantially avoid the transfer of ink from the printing region to the bin, to thereby substantially avoid the possibility that the image could get blurred or stained.

However, an interswath drying time extending for a relatively long period of time may also produce problems. A problem which occurs frequently in ink-jet printing is the "slewing decap" effect. If the printhead has been out of its service station without firing beyond a predetermined time, the pigment in the ink may move back into its channel away from the firing chamber of the printhead. It will be appreciated that the main constituents of printer ink are an appropriately-colored pigment fraction and a more volatile vehicle fraction for conveying the pigment. If the pigment moves back into the channel, the liquid remaining in the firing chamber is basically the vehicle fraction (the first few drops of ink printed will basically have no pigment left). The result of this effect is incomplete, blank or blurred lines, or in the worst cases defective borders in images.

The defect may become worse the longer the time the printhead, otherwise known as a "pen", is out of the capping position (i.e., without spitting).

Thus, there is a need to control the interswath drying time so that it is within a predetermined range of time.

One previous proposal was to determine interswath drying time only as a function of the print media used. Thus, for types of paper which needed a long drying time, a longer interswath drying time was set; whereas, for thicker and more absorbent media, a shorter drying time was set.

A disadvantage of this previous proposal was that it was relatively coarse and did not take into account various relevant factors, including stewing decap. Once set, operation of this previous proposal caused the interswath drying time to remain constant throughout a single plot.

Separate proposals have been made to overcome the problem of slewing decap. For example, the effects of slewing decap can be substantially reduced by the use of multiple pass printing. Multiple pass printing typically involves the printing of each swath in a plurality of passes, in which an appropriate fraction of the total number of dots is deposited during each pass. This technique substantially reduces the throughput of a printer because of the increased printing time necessary to perform the multiple passes. Another solution is to cause the pens to spit extensively before the swaths are printed. This increases costs due to the amount of ink wasted in the spitting process and also reduces throughput because of the time required to perform the spitting operations. U.S. Pat. No. 5,714,990 discloses an ink jet printer in which a printing operation is controlled based on the density of the image to be printed. The printing frequency of firing the ink jets is controlled to ensure that the ink jets have time to refill between swaths. A dry time per swath is calculated, and is utilized at the end of a plot when a check is made, regardless of whether any previously printed swath has had insufficient drying time to prevent smearing by an adjacent sheet.

U.S. Pat. No. 5,608,439 discloses a printing mechanism in which a swath drying time is determined in order that the printhead is not caused to smear ink in the preceding swath when printing the current swath. Thus, data concerning a just-printed swath is taken into account. In addition, look up tables are maintained for different paper sizes and print modes.

U.S. Pat. No. 4,469,026 relates to the end of plot dry time and takes into account print density, ink characteristics, humidity and temperature.

SUMMARY OF THE INVENTION

Certain aspects of the present invention seek to overcome or reduce one or more of the above problems.

According to a first aspect of the present invention, there is provided a method of reducing bleeding between ink deposited on a print medium in successive passes in a printing operation. In the method, the amount of ink deposited is determined and the drying time is varied between successive passes to keep the amount of bleeding below a predetermined level.

According to a second aspect of the invention, there is provided a hardcopy apparatus including a movable carriage carrying a printhead and a drive device arranged to advance a print medium through the apparatus. The printhead is arranged to deposit ink on the print medium in a print zone as the carriage moves in passes across the print medium. A control means is provided and arranged to vary the drying time between successive passes in dependence on the amount of ink deposited to keep the amount of bleeding between successive passes below a predetermined level.

The predetermined level may be determined solely on the basis of the ink deposited. Thus, it may be based on the previously deposited ink being substantially dry. It may also be based on the level of bleeding allowed being imperceptible to the unaided eye. It may further be based on the maximum distance which the ink is permitted to travel in the bleeding direction, i.e., transversely of the swath.

Alternatively, the predetermined level may also take into account the slewing decap effect mentioned above, so that a compromise level may be determined between the drying time being too short and too long.

According to a third aspect of the present invention, there is provided a hardcopy apparatus including a movable carriage carrying a printhead and a drive device arranged to advance a print medium through the apparatus. The printhead is arranged to deposit ink on the print medium in a print zone as the carriage moves in passes across the print medium. The apparatus also includes a detector for detecting the amount of ink $I_1$ deposited in a preceding printing pass and/or detecting the amount of ink $I_2$ to be deposited in a succeeding printing pass. The apparatus further includes a control device, in which the detector is connected to the control device and the control device controls the time $k'_i$ between successive passes in accordance with the formula $$k'_i=k_i(1-c_i(I-I_0))$$

where $k_i$ is a basic interpass drying time, which is a constant for a particular type of print media;

I is $I_1$ or $I_2$ or a suitable function of the two values;

$I_0$ is reference amount of ink deposited; and $c_i$ is a positive empirically determined constant.

According to a fourth aspect of the present invention, there is provided a hardcopy apparatus including a movable carriage carrying a printhead and a drive device arranged to advance a print medium through the apparatus. The printhead is arranged to deposit ink on the print medium in a print zone as the carriage moves in passes across the print medium. The apparatus also includes a print medium indicator, a humidity sensor for detecting the relative humidity HR, a temperature sensor for detecting the temperature T, a detector for detecting the amount of ink $I_1$ deposited in a preceding printing pass and/or for detecting the amount of ink $I_2$ to be deposited in a succeeding printing pass. The apparatus further includes a control device. The indicator, the sensors and the detector are connected to the control device, and the control device controls the time $k'_i$ between successive passes in accordance with the formula $$k'_i=k_i)1-a_i(T-T_0)+b_i(HR-HR_0)+(+c_i(I-I_0))$$

where $k_i$ is a basic interpass drying time which is a constant for a particular type of print media;

$T_0$ is a reference temperature $HR_0$ is a reference relative humidity;

I is $I_1$ or $I_2$ or a suitable function of the two values;

$I_0$ is reference amount of ink deposited;

and $a_i$, $b_i$ and $c_i$ are positive empirically-determined constants.

BRIEF DESCRIPTION OF THE DRAWINGS

Preferred embodiments of the present invention will now be described, by way of example only, with reference to the accompanying drawings, of which.

DETAILED DESCRIPTION OF PREFERRED EMBODIMENTS

Figure 1:
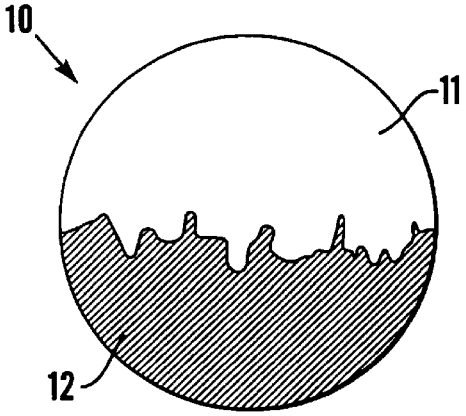
Fig. 1 Prior Art
FIG. 1 shows an enlarged view of part of image printed in accordance with the prior art with adjacent color blocks.

Referring to the drawings, FIG. 1 shows part of a prior art printed image 10 with adjacent color blocks 11 and 12. Because insufficient drying time was allowed between the two swaths concerned, the inks of the two colors have bled into each other and have thus produced a blurred border.

Figure 2:
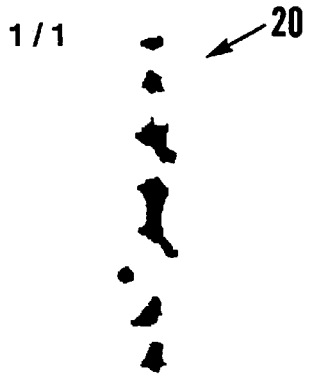
Fig. 2 Prior Art
FIG. 2 shows an enlarged view of a straight line printed in accordance with the prior art.

FIG. 2 shows a straight line 20 printed in a prior art arrangement in which too long a time elapsed between successive printing passes, so that there was insufficient pigment in the ink in the pen when it was fired to produce the line.

Figure 3:
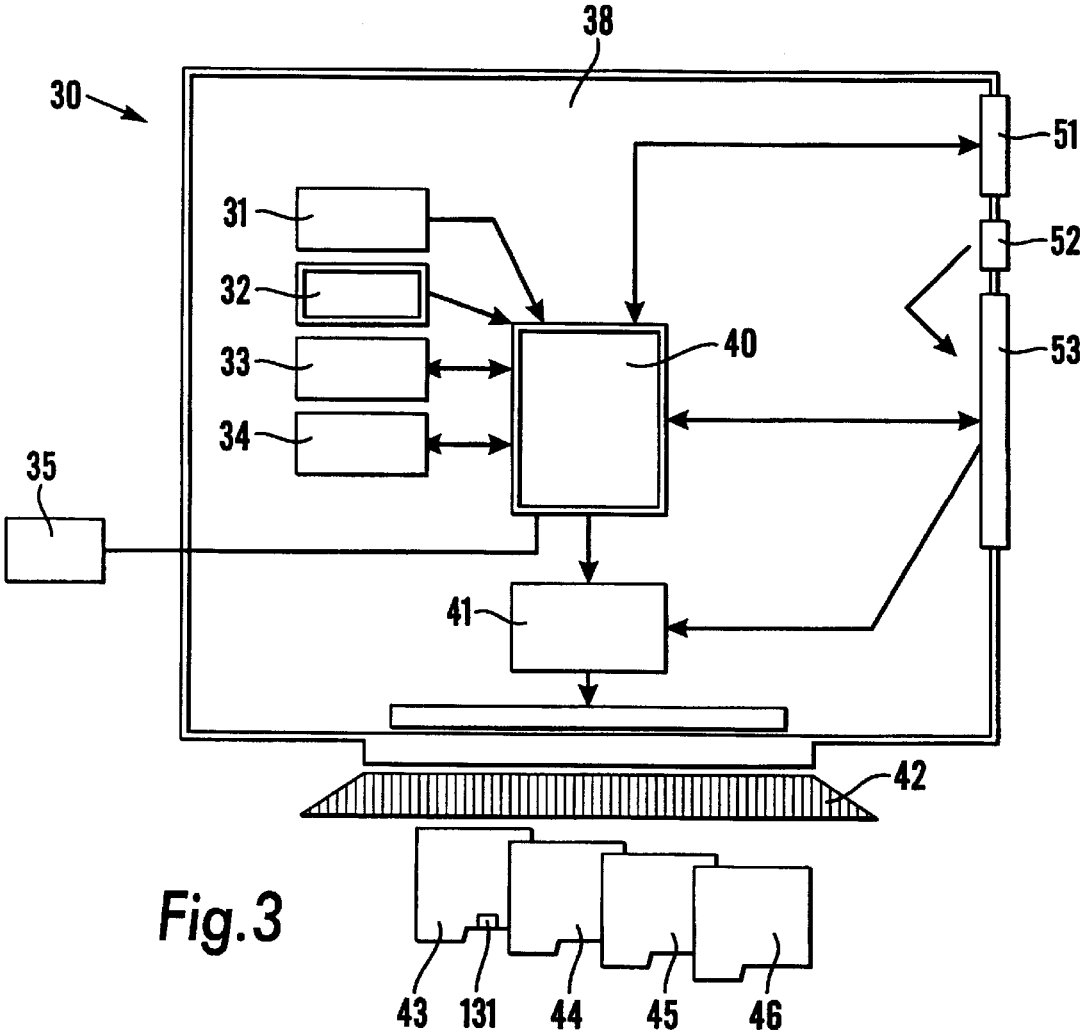
FIG. 3 shows a schematic view of part of a printer in accordance with a preferred embodiment of the present invention.

FIG. 3 shows, in schematic form, the printer carriage 30 of an ink-jet printer in accordance with the present invention. The carriage printed circuit assembly (PCA) 38 includes a thermal sense resistor 31 for detecting the ambient temperature, and a humidity sensor 32 for detecting the prevailing humidity.

The temperature sense resistor 31 has a resistivity R which changes as a function of temperature according to the equation:

$$R=Ro(1+\alpha T)$$

where Ro is the resistivity at the zero of the temperature scale and $\alpha$ is the temperature coefficient of resistivity.

The carriage PCA 38 also includes a counter 33 for counting the number of times a black pen of the printhead is fired in a single swath in accordance with an ink-drop counting algorithm. Similarly, a counter 34 for counting the number of times each of the color pens of the printhead is fired in a swath is also provided in the PCA 38. The printer also includes switch or keypad means 35 for entering an indication of the type of print medium currently located in the printer.

The carriage PCA 38 is connected via a flexible connector arrangement 42 to PCAs for pens or printheads 43, 44, 45, 46. A module 41 detects any electrical malfunctioning in the PCAs for the printheads 43, 44, 45, 46 and serves to effect disconnection to protect the carriage PCA 38. Further electrical connections to the carriage PCA 38 are indicated at 51, 52 and 53. Connector 53 connects the carriage via a trailing cable (not shown) to the main PCA, i.e., the circuitry mounted in the fixed part of the printer.

The switch or keypad means 35 forms part of a front panel of the printer and is attached to the main PCA. The media type is selected by a user and this information is communicated to the carriage PCA at the beginning of each plot.

The counters 33, 34 may conveniently be configured in either hardware or software. In the latter case, the necessary values may be derived from the flow of data from the main PCA through connector 53 to carriage PCA 38.

The outputs of sensors 31, 32, counters 33, 34 and switch or keypad means 35 are fed to a carriage-mounted microprocessor 40, which, for each pass, calculates the value of the required interswath drying time in dependence on the actual temperature, humidity and the amount of ink printed in the previous pass.

The microprocessor 40 undertakes the following calculation:

$\text{Interswath}_n$ drytime=f (media, HR, T, I)

(Where T, HR and I are the temperature, Relative Humidity and amount of ink used in the previous pass, respectively, and 'n' is the pass number)

Example Before we had . . .

Interswath drytime=$k_i$

End of plot drytime=$K_i$ (where $K_i$ and $k_i$ are constants for each type of print media)

Total drytime=$K_i+nk_i$

Now, for each interswath drytime we calculate:

Interswath drytime=$k'i=k_i(1-a_i(T-T_0)+b_i(HR-HR_0)+c_i(I-I_0))$ Equation I (where $a_i$, $b_i$, and $c_i$ are positive experimental constants.)

At the end of a plot, a correction is made to the "end of plot" drying time as follows:

End of plot drytime=$K_i+nk_i-\Sigma k'_i$, so that

Total drytime=$K_i+nk_i$(the same).

This means that the total drying time allowed remains unchanged so that throughput is not affected.

An advantage of the above-described arrangement is that the interswath drying time is determined in each particular case depending on the image type, the ink used and the temperature and humidity conditions. This interswath drytime is determined at each pass because the amount of ink used in each pass may differ significantly. For instance, if there are only lines in the image, this will reduce the interswath drying time to a minimum value because lines are particularly sensitive to slewing decap and long interswath drying times are not needed, e.g., due to a limited amount of ink on the page there is no risk of bleeding, etc. On the other hand, if there is a lot of ink on the page, the interswath drying time increases because a lot of ink has already been fired (leading to an increase in bleeding risk) and the risk of slewing decap is in any case lower (because slewing decap only affects the first few drops when the pen has been idle for a long time, which may not be applicable in this situation).

Figure 4:
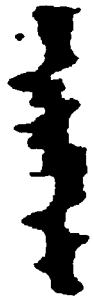
FIG. 4 shows an enlarged view of a straight line printed in accordance with the present invention.

One particular advantage of the present invention is the ability to print clear lines on print media for which ink dries slowly. In prior art arrangements, because different types of images had to be taken into consideration, the interswath drying time was fixed at a relatively high level. The present invention affords the flexibility of substantially reducing the drying time so that the printed lines are not defective. An enlarged representation of such a line is shown in FIG. 4. At actual size, the line appears normal and well-defined. In fact the drying time is made optimal for all types of printed output.

Various modifications may be made to the above-described arrangement. For example the thermal sense resistor 31 may be placed in a different location. In a preferred embodiment, a thermal sense resistor, indicated schematically at 131, is located close to the printheads 43–46 and connected to the printhead PCAs. An advantage here, is that the temperature is sensed directly adjacent to the print medium. A further advantage is that printheads often already incorporate a thermal sense resistor and so the preexisting resistor may be used with only a minor modification to the printhead PCA. In addition, each printhead may have a respective thermal sense resistor.

According to another embodiment, the thermal sense resistor may be connected to the main PCA. In addition, thermal sense resistors may be provided in more than one of the above locations, in which case, means may be provided for supplying an average or suitably-weighted signal to the microprocessor 40. Other types of temperature sensors than resistors may be employed.

Similarly, the humidity sensor 32 may be replaced or supplemented by sensors associated with other PCAs of the printer.

In addition to switch or keypad means or print media indicator 35, there may also be provided an indicator for the type of ink being used. This enables the calculation of interswath drying time to take into account the thickness of the ink. The ink indicator may also include switch or keypad means. Alternatively, the printhead cartridges employed may incorporate optical or other codes which are automatically read by a reader mounted on the carriage 30. The codes may include an indication of the type of ink contained in the cartridges.

An internet connection may be provided for the printer so that the relevant formula to be used for calculating the interswath drying time can be downloaded into microprocessor 40 to take into account the ink and/or print media to be used.

The microprocessor 40 may take into account data from counters 33, 34 relating to a plurality of immediately preceding swaths. In this case, a mathematical average or a weighted average of the various values may be used in determining the drying time.

The microprocessor 40 may additionally take into account a value indicative of the amount of ink configured to be applied in the next pass to be printed. This factor also has an influence on the bleeding and mottling effects. It is derived from the data flowing from the main PCA to the carriage PCA 38.

Thus, if an amount of ink $I_1$ is printed in pass 1 and we know that an amount of ink $I_2$ is to be printed in the next pass, pass 2, the third term in the right hand side of Equation I above should be replaced by:

(i)

$$c\frac{(I_1+I_2-I_0)}{2},$$

i.e., using the average of $I_1$ and $I_2$; or (ii) $c(I_{max}-I_0)$ where $I_{max}$ is the greater of $I_1$ and $I_2$, i.e., using the maximum of $I_1$ and $I_2$; or where $I_{max}$ is the greater $I_1$ and $I_2$, i.e., using the maximum of $I_1$ and $I_2$; or (iii)

$$c\frac{(lI_1+mI_2-I_0)}{1+m},$$

where l and m are constants; i.e., using a suitable weighted average of $I_1$ and $I_2$; or (iv) any other convenient function of $I_1$ and $I_2$.

An advantage of taking into account both $I_1$ and $I_2$ is that this bears a closer relationship to the magnitude of the bleeding.

The microprocessor 40 may take into account the ink to be deposited in a plurality of immediately-succeeding swaths.

In another modification, the amount of ink to be used in the next pass may replace the amount of ink in the preceding pass in Equation I.

The printer may operate unidirectionally or bidirectionally with the drying time being calculated between each pass. For unidirectional printing, the drying time includes the time taken for carriage 30 to return. Multiple-pass printing may be effected, in which case it is the drying time between individual passes that is calculated.

Although described in connection with ink-jet printers, arrangements according to the present invention may be used in connection with other types of printers, e.g. piezoelectric printers or, indeed, any apparatus employing ink with a water or liquid component which needs to dry out between passes.

Although the preferred embodiment modifies the "end of plot" drying time to maintain constant throughput, this is not essential. By setting a constant "end of plot" drying time or varying it in some other way, it is possible to improve the throughput of printing tasks.

Instead of determining the drying time by a calculation process, the microprocessor may employ one or more look-up tables.

The drying time may be determined solely on the amount of ink deposited (whether in the preceding pass, the succeeding pass or both). This may be combined with any one, two, three or four of the additional factors: type of ink, humidity, temperature, type of print media. Thus, in the right hand side of Equation I, one or both of the factors relating to temperature and humidity may be omitted when calculating the interswath drying time.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims - - - and their equivalents - - - in which all terms are meant in their broadest reasonable sense unless otherwise indicated.

What is claimed is:

1. A hardcopy apparatus comprising:

a movable carriage carrying a printhead;

a drive device arranged to advance a print medium through said apparatus, said printhead being arranged to deposit ink on said print medium in a print zone as the carriage moves in passes across said print medium;

a detector for detecting the amount of ink $I_1$ deposited in a preceding printing pass and/or detecting the amount of ink $I_2$ to be deposited in a succeeding printing pass; and a control device, wherein said detector is connected to said control device and said control device controls the time $k'_i$ between successive passes in accordance with the formula:

$$k'_i=k_i(1-c_i(I-I_0))$$

where $k_i$ is a basic interpass drying time which is a constant for a particular type of print media;

I is $I_1$ or $I_2$ or a suitable function of the two values;

$I_0$ is reference amount of ink deposited; and $c_i$ is a positive empirically-determined constant.

2. The hardcopy apparatus according to claim 1, wherein a receptacle is provided downstream of said print zone for receiving said print medium after printing thereon has finished and wherein said control device controls the end of plot time between the final printing pass and transfer of said print medium from said print zone to said receptacle to thereby substantially keep at a constant the total of all said times between successive passes and said end of plot time for successive similar print media.

3. A hardcopy apparatus comprising:

a movable carriage carrying a printhead;

a drive device arranged to advance a print medium through said apparatus, said printhead being arranged to deposit ink on said print medium in a print zone as the carriage moves in passes across said print medium;

a print media indicator;

a humidity sensor for detecting the relative humidity HR;

a temperature sensor for detecting the temperature T;

a detector for detecting the amount of ink $I_1$ deposited in a preceding printing pass and/or detecting the amount of ink $I_2$ to be deposited in a succeeding printing pass; and a control device, wherein said indicator, said humidity sensor, said temperature sensor and said detector are connected to said control device, and said control device is configured to control the time $k'_i$ between successive passes in accordance with the formula:

$$k'_i=k_i(1-a_i(T-T_0)+b_i)HR-HR_0)+c_i(I-I_0))$$

where $k_i$ is a basic interpass drying time which is a constant for a particular type of print media;

To is a reference temperature $HR_0$ is a reference relative humidity;

I is $I_1$ or $I_2$ or a suitable function of the two values;

$I_0$ is reference amount of ink deposited;

and $a_i$, $b_i$ and $c_i$ are positive empirically-determined constants.

4. The hardcopy apparatus according to claim 3, wherein a receptacle is provided downstream of said print zone for receiving said print medium after printing thereon has finished and wherein said control device controls the end of plot time between the final printing pass and transfer of said print medium from said print zone to said receptacle to thereby substantially keep at a constant the total of all said times between successive passes and said end of plot time for successive similar print medium.

5. A method of reducing bleeding between ink deposited on a print medium in successive passes in a printing operation, the method comprising:

determining the amount of ink $I_1$ deposited on said print medium in a preceding pass and/or detecting the amount of ink $I_2$ to be deposited in a succeeding printing pass and varying the drying time $k'_i$ between successive passes in accordance with the formula:

$$k'_i=k_i(1-c_i(I-I_0))$$

where $k_i$ is a basic interpass drying time which is a constant for a particular type of print media;

I is $I_1$ or $I_2$ or a suitable function of the two values;

$I_0$is reference amount of ink deposited; and $c_i$ is a positive empirically-determined constant, to thereby maintain the amount of bleeding below a predetermined level.

6. The method according to claim 5, further comprising:

varying the drying time in dependence upon at least one of the following factors:

the type of ink being used, the prevailing temperature, the prevailing humidity, and the type of print media being used.

7. The method according to claim 5, further comprising:

varying an end of plot time between a final printing pass in the printing operation and a passing of the print media to a subsequent stage to substantially keep at a constant the total of all of said drying times between successive passes and said end of said plot time for successive print media.

8. A method of depositing ink on a print medium in successive passes in a printing operation, the method comprising:

determining the amount of ink deposited on said print medium, varying the drying time between successive passes in dependence upon said deposited amount of ink, to thereby maintain the amount of bleeding below a predetermined level, and varying an end of plot time between a final printing pass in the printing operation and a passing of the print media to a subsequent stage to substantially keep at a constant the total of all of said drying times between successive passes and said end of said plot time for successive print media.

9. A method of depositing ink on a print medium in successive passes of a printhead in a printing operation, the method comprising:

determining the amount of ink deposited on said print medium and varying the drying time between successive passes in dependence upon said deposited amount of ink, to thereby maintain the amount of bleeding below a predetermined level, and varying said drying time between successive passes to substantially avoid ink from remaining in a printhead beyond a predetermined length of time prior to being fired.

10. A method of reducing bleeding between ink deposited on a print medium in successive passes in a printing operation, the method comprising:

determining for each said successive pass the amount of ink to be deposited on said print medium in said pass and varying the drying time between successive passes in dependence upon said deposited amount of ink to be deposited, to thereby maintain the amount of bleeding below a predetermined level.

11. The method according to claim 10, further comprising:

determining the amount of ink deposited in a preceding pass and varying the drying time additionally in dependence upon said amount of ink deposited in said preceding pass.

12. The method according to claim 10, further comprising:

varying the drying time in dependence upon at least one of the following factors:

the type of ink being used, the prevailing temperature, the prevailing humidity, and the type of print media being used.

13. A hardcopy apparatus comprising:

a movable carriage carrying a printhead;

a drive device arranged to advance a print medium through said apparatus, said printhead being arranged to deposit ink on said print medium in a print zone as the carriage moves in passes across said print medium;

control means arranged to vary the drying time between successive passes in dependence on the amount of ink deposited to thereby maintain the amount of bleeding between successive passes below a predetermined level, and a temperature varying resistance element provided on or adjacent said printhead, wherein said temperature varying resistance element provided on or adjacent said control means, and where the drying time is varied in dependence upon the prevailing temperature.

* * * * *